US005613459A

United States Patent [19]

Remy

[11] Patent Number: 5,613,459

[45] Date of Patent: Mar. 25, 1997

[54] TOWABLE FLOATING STORAGE ACCESSORY FOR USE WITH WATERCRAFT

[76] Inventor: Andrew P. Remy, 8220 Sandpiper Cir., Fort Worth, Tex. 76138

[21] Appl. No.: 582,693

[22] Filed: Jan. 4, 1996

[51] Int. Cl.[6] ..... B63B 35/00

[52] U.S. Cl. ..... 114/270; 114/242; 114/343

[58] Field of Search ..... 114/242, 248, 114/249, 251, 270, 343, 364; 441/34, 40, 43, 67, 81, 129, 131, 136

[56] References Cited

U.S. PATENT DOCUMENTS

| | | | |
|---|---|---|---|
| D. 325,020 | 3/1992 | Doherty | D12/310 |
| 2,876,467 | 3/1959 | Lund | 441/40 |
| 3,490,085 | 1/1970 | Lewis . | |
| 3,670,349 | 6/1972 | Moore . | |
| 3,798,690 | 3/1974 | Moore | 114/68 |
| 4,619,620 | 10/1986 | Felter | 441/131 |
| 4,689,844 | 9/1987 | Alivizatos | 5/437 |
| 4,911,094 | 3/1990 | Akers | 441/40 |
| 5,119,752 | 6/1992 | Doherty | 114/361 |
| 5,122,086 | 6/1992 | Remy | 114/345 |
| 5,279,510 | 1/1994 | Remy | 441/129 |

FOREIGN PATENT DOCUMENTS

| | | |
|---|---|---|
| 716162 | 1/1942 | Germany . |
| 1197364 | 4/1963 | Germany . |

*Primary Examiner*—Jesus D. Sotelo
*Attorney, Agent, or Firm*—Geoffrey A. Mantooth

[57] ABSTRACT

A storage accessory is used in conjunction with a personal watercraft in order to increase the storage capacity of the personal watercraft. The storage accessory has a rigid container that forms a storage compartment. The storage container is cylindrical so as to fit inside of a toroid inflatable tube. The tube has a cover around its sides and bottom. A flange is coupled to the container and bears on the top of the tube so as to keep the bottom of the container flush with the bottom of the tube. The tube cover is coupled to the stern of the personal watercraft with a multi point coupling so as to cause some deformation of the tube. This makes the storage accessory an extension of the watercraft hull so that the storage accessory moves in unison therewith. The leading edge of the storage accessory rides on top of the transom so that the water propulsion jet is located underneath the storage accessory, pushing it up. The storage accessory can be removed from the tube and used as a table.

16 Claims, 4 Drawing Sheets

TOWABLE FLOATING STORAGE ACCESSORY FOR USE WITH WATERCRAFT

FIELD OF THE INVENTION

The present invention relates to storage accessories for use with watercraft and especially for use with personal watercraft.

BACKGROUND OF THE INVENTION

Personal watercraft, such as jet skis, are becoming more and more popular. A personal watercraft is essentially a small motorized boat. The operator straddles a seat that extends parallel to the boat's keel. Two people can be accommodated by sitting tandem on the seat.

Operators of personal watercraft often wish to utilize their watercraft for activities other than just tiding. For example, a personal watercraft can pull a water skier. Also, the operator may wish to bring along food and drink and other equipment. Unfortunately, other than a seat for the operator and passenger, a personal watercraft has very little storage capacity.

Thus, it is desirable to increase the carrying capacity of a personal watercraft.

In the prior art, several towable floating accessories have been made. Doherty, U.S. Pat. Nos. 5,119,752 and Des. U.S. Pat. No. 325,020 disclose a sled that is trailed behind a personal watercraft. The accessory has a rigid hull. One disadvantage is that the prior art sled is heavy and bulky and is therefore difficult to carry.

Another disadvantage is that use of the prior art sled requires a trailer hitch located on the stern of the towing personal watercraft. The stern of the personal watercraft is frequently used to board the personal watercraft from the water, when the sled is not in use. However, the trailer hitch makes stern boarding difficult.

Still another disadvantage is that the coupling between the prior art sled and the personal watercraft is rigid. The sled moves across the water in a manner that is somewhat independent of the movement of the personal watercraft. This puts strain on the stern of the personal watercraft and makes control of the personal watercraft difficult to accomplish, especially in rough water. Some operators report that at times, the sled begins to hop behind the personal watercraft. This causes discomfort in operating the watercraft.

Still another prior an sled is called the Aquasled and resembles the sled of Doherty. The towing arm of the Aquasled has a swivel that allows the sled to move more flexibly with respect to the sled. Unfortunately, the Aquasled sometimes turns completely over in the water.

SUMMARY OF THE INVENTION

It is an object of the present invention to provide a towable accessory for carrying objects, for use with a personal watercraft, which accessory moves in unison with a personal watercraft.

It is another object of the present invention to provide a towable accessory for carrying objects for use with a personal watercraft, which accessory can be easily trailed to and from water.

It is another object of the present invention to provide a towable accessory for carrying objects for use with a personal watercraft, which accessory can be easily lifted and moved from one location to another.

It is another object of the present invention to provide a towable accessory for carrying objects for use with a personal watercraft, which accessory can store and carry a variety of articles.

The storage accessory of the present invention is for use with a personal watercraft. The storage accessory includes a container and a floatable member. The container includes a side wall that forms a storage compartment therein. The side wall has a top and a bottom, and a bottom wall that is coupled to the bottom of the side wall so as to close off the bottom of the storage compartment. The container has a rigid flange that extends from the top of the side wall. The floatable member encircles the side wall of the container, with the flange bearing on a top surface of the floatable member. The floatable member is flexible and is coupled to a stern of the personal watercraft.

In accordance with one aspect of the present invention, the floatable member comprises a toroidally shaped tube and a cover that extends around a top of the tube, and outside of the tube, and the bottom wall of the container.

In accordance with another aspect of the present invention, the side wall and bottom wall of the container are rigid and the bottom wall is flush with bottom of the tube.

In accordance with another aspect of the present invention, the container is removable from the floatable member. The container is easily picked up and moved by grasping the flange. The container can be moved from the tube onto a beach area and used as a table.

In accordance with another aspect of the present invention, the floatable member is pressed against the stern of the personal watercraft so as to cause deformation of the floatable member. The floatable member is coupled to the personal watercraft with a multi point coupling. The coupling of the floatable member to the stern causes the storage accessory to become an extension of the watercraft hull. Thus, the storage accessory moves in unison with the watercraft in turning, pitching, and rolling.

Furthermore, the floatable member overlaps a transom of the personal watercraft. The personal watercraft is propelled by a jet of water exiting from underneath the stern of the watercraft. By positioning a leading edge of the floatable member on top of the transom, the water propulsion jet is located beneath the storage accessory, thereby lifting the storage accessory. This allows the storage accessory to plane over the water.

Furtherstill, the storage accessory has a low center of gravity, thereby enhancing its stability on the water.

In accordance with another aspect of the present invention, a cushion is located inside of the storage compartment and on top of the bottom wall. A cargo net is located inside of the storage compartment. Objects that are in the storage compartment are located on top of the cushion and underneath the net.

In accordance with another aspect of the present invention, the storage compartment is covered by a lid. The lid has a wall depending therefrom, which wall forms a small container therein. This small container is useful for carrying items such as gas cans or serving as an ice chest. The small container separates its contents from the contents of the larger, or main, storage compartment.

DESCRIPTION OF THE PREFERRED EMBODIMENT

Figure 1:
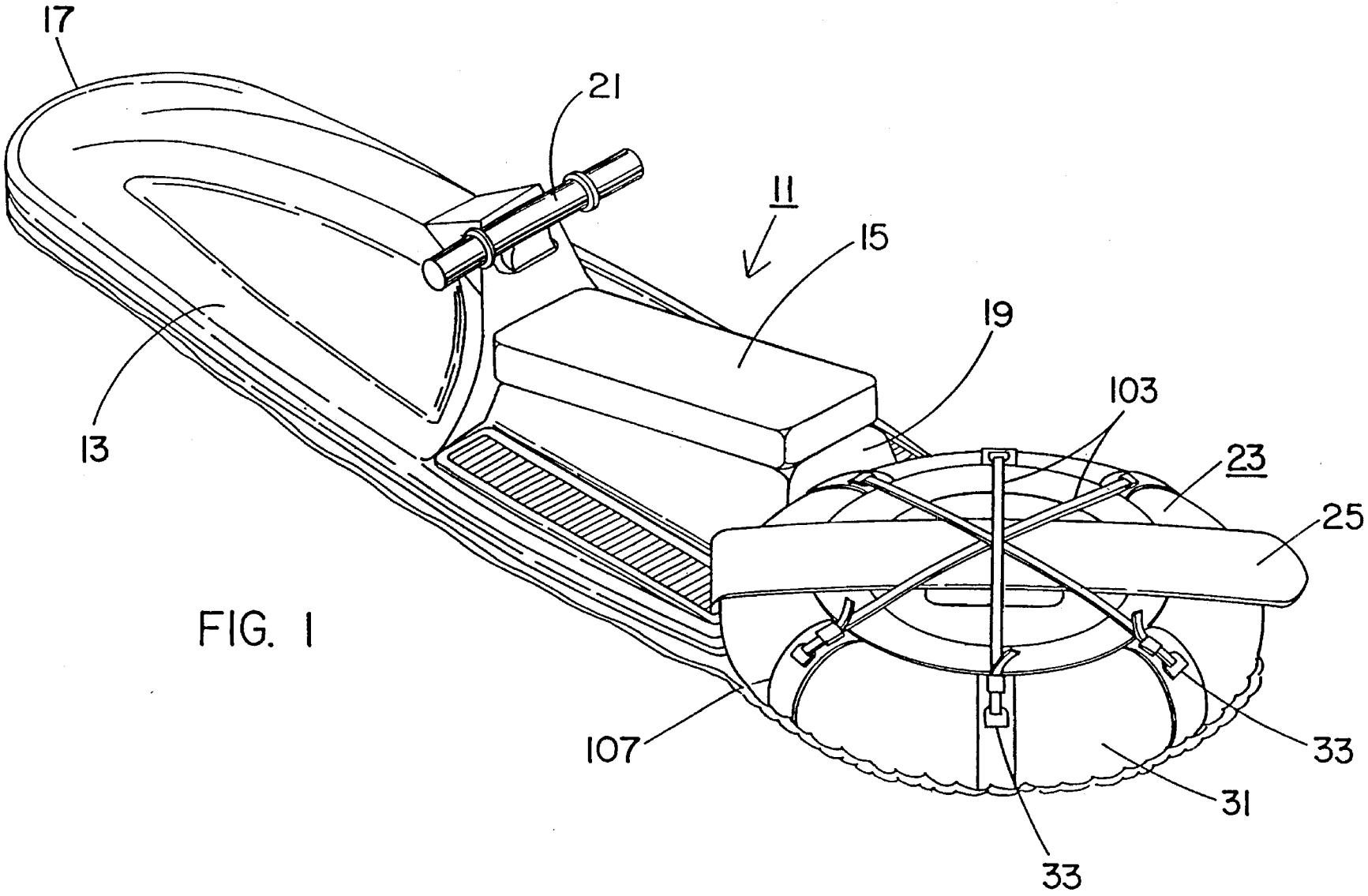
FIG. 1 is an isometric view of a personal watercraft towing the storage accessory of the present invention, in accordance with a preferred embodiment.

In FIG. 1, there is shown a personal watercraft 11. The personal watercraft 11 is conventional and commercially available. It has a hull 13 and a seat 15 on top of the hull. The hull has a bow 17 and a stern 19. A steering arrangement 21 is provided with motorcycle-like handles.

As can be seen from the drawing, the personal watercraft 11 itself does not have much storage capacity other than for its passengers. The passengers (that is the operator and one or two other humans) straddle the seat 15 in tandem fashion. The personal watercraft of course does have an onboard gas tank (not shown).

Coupled to the stern 19 of the personal watercraft 11 is the storage accessory 23 of the present invention, in accordance with a preferred embodiment. The storage accessory greatly increases the storage capacity of the personal watercraft 11. The storage accessory provides a watertight storage compartment for carrying items such as towels, food, drink, and electronic equipment. There is also a flat top, wherein large items, which are too big to fit inside of the water tight compartment, can be secured with line or rope. These large items include skis 25, folding chairs, and umbrellas. In addition, a gasoline container can be carried in a small storage compartment contained within the lid.

The storage accessory 23 is hydrodynamically compatible with the personal watercraft 11. The storage accessory 23 is coupled to the stern 19 of the personal watercraft (see FIG. 2) in such a manner so as to move in unison with the personal watercraft. Thus, as the personal watercraft banks to turn, the storage accessory will also bank in the same direction. As the personal watercraft pitches due to waves, the storage accessory will likewise pitch.

Figure 3:
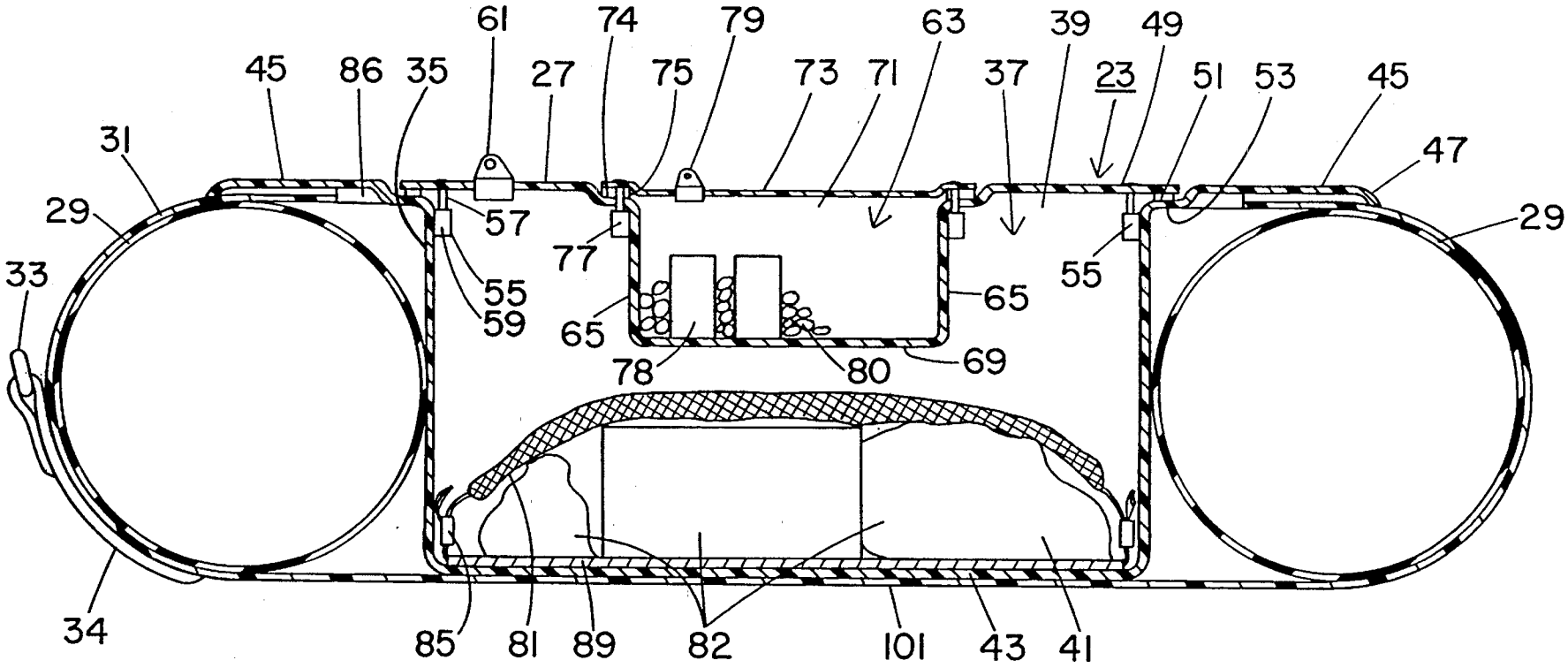
FIG. 3 is an elevational cross-sectional view of the accessory.

Referring to FIG. 3, the storage accessory 23 will now be described in detail. The storage accessory has a rigid container 27 located inside of a flexible tube 29. The container 27 provides the storage compartment, while the tube 29 provides floatation. There is also a tube cover 31 around the outside of the tube 29. The tube cover 31 improves the hydrodynamic capability of the tube as the tube is towed over water. In addition, the tube cover 31 provides eyelets 33 for coupling the storage accessory 23 to the personal watercraft 11 and to tie down objects 25 (see FIG. 1) on top of the storage accessory.

Figure 4:
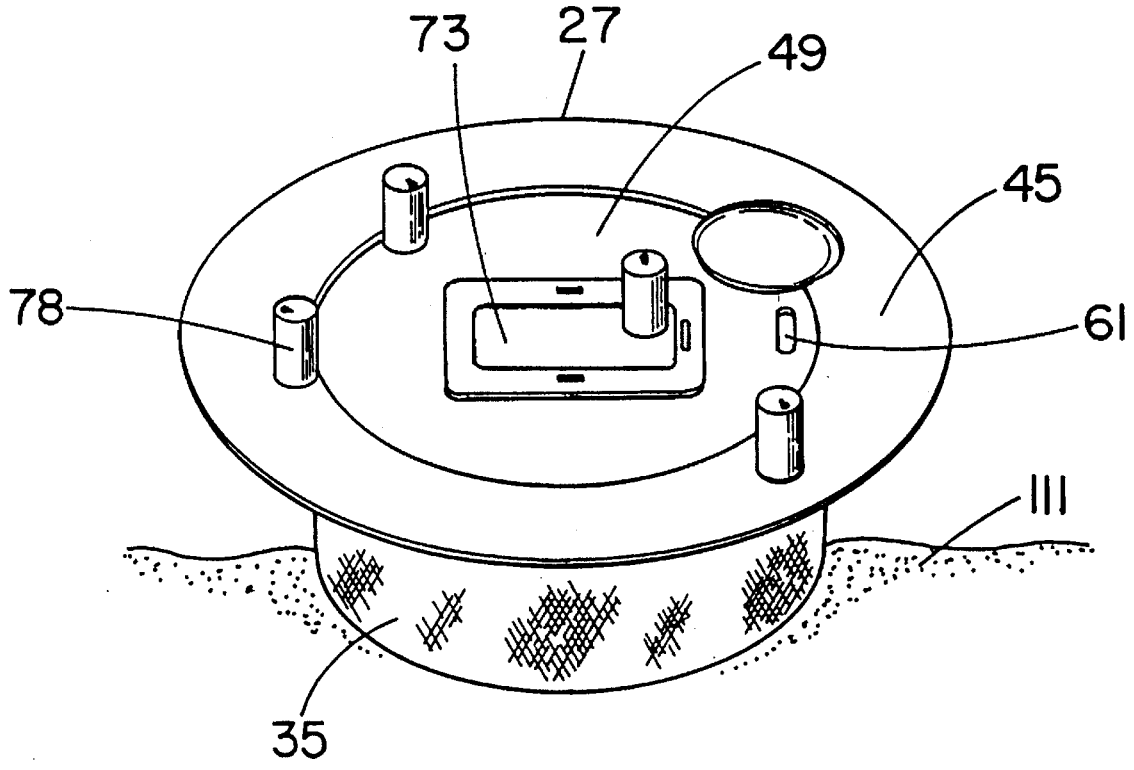
FIG. 4 is an isometric view of the storage container shown being used as a table.

Referring to FIGS. 3 and 4, the container 27 has a cylindrical side wall 35 that forms a storage compartment 37. The storage compartment 37 has a top end 39 and a bottom end 41. A bottom wall 43 encloses the bottom end 41 of the storage compartment 37 and is coupled to the cylindrical wall 35. The top end 39 of the storage compartment is open to allow access thereto. A flange 45 extends radially outward from the top edge 39 of the cylindrical side wall 35. The outer edge 47 of the flange is curved down (relative to the bottom wall 43). This contour of the outer edge 47 allows to the flange to better fit onto the curved contour of the tube 29.

A lid 49 closes the top end 39 of the storage compartment 37. The lid is circular in a plan view. The outer edge of the lid 49 has a foam seal 51, which seal extends around the entire perimeter of the lid. The seal 51 makes the storage compartment 37 watertight. The seal 51 is received by a shoulder 53 that is formed on the inner edge of the flange 45. The lid 49 is secured in place by two latches 55 that are diametrically opposed to each other. Each latch 55 has a hook 57 that depends from the inside of the lid 49. Each hook 57 is received by a clasp 59 that is mounted to the inside surface of the side wall 35. The lid 49 is also provided with a handle 61 on its outer surface. In the preferred embodiment, the handle 61 is recessed and can be pivoted out for use.

The lid 49 has a smaller storage compartment 63 that is nested inside of the larger, or main, storage compartment 37. The lid 49 has a side wall 65 that depends therefrom. The lid itself forms a flange. The side wall 65 forms the small storage compartment 63. The bottom end of the storage compartment is closed by a bottom wall 69. The top end 71 of the small storage compartment 67 is open to allow access thereto. A small rectangular lid 73 fits over the opening so as to close the small storage compartment. The inner edge of the large lid 49 has a shoulder 74. The shoulder receives a foam seal 75 that is located around the perimeter of the small lid 73. The small lid 73 has latches 77 and a handle 79 that are substantially similar to those of the large lid 49.

In the preferred embodiment, the small storage compartment 63 is rectangular in shape to accommodate a gasoline can or an ice chest. For example, FIG. 3 shows beverage cans 78 and ice 80 located in the small storage compartment. However, the small storage compartment need not be rectangular, but can be some other shape.

When the large lid 49 is in place on the container 27, the small storage compartment 63 is located inside of the large storage compartment 37.

Inside of the large storage compartment 37 is a net 81 or a mesh to keep objects 82 (such as towels, clothes, and a radio) pinned to the bottom wall 43. The net 81 is circular and has 4 lengths of webbing 83 extending radially outward therefrom. The lengths of webbing are spaced 90 degrees apart around the perimeter of the net. A clasp 85 is used to couple each length of webbing 83 to the bottom wall 43. A cushioning layer of foam 89 is located on top of the bottom wall 43.

In the preferred embodiment, the container 27 is made of fiber glass or plastic. The container 27 is rigid. The latches and handles are rivoted to their respective walls and lids.

The tube 29 and the tube cover 31 are conventional and commercially available. Similar items are described in my U.S. Pat. No. 5,122,086 the disclosure of which is incorporated herein by reference. The inflatable tube 29 is toroidal and is made of rubber. Thus, there is a central opening formed by the tube. The cover, which is made of vinyl, extends around the outer circumference of the tube. The cover also extends across the bottom of the central opening of the tube. The top of the central opening is however left open. Reinforcing webbing 86 is used around the edge of the cover at the top of the central opening. The tube can be inflated with a tank of air or pump.

The container 27 is located inside of the tube 29 such that the container cylindrical wall 35 contacts the inside of the tube 29, the container bottom wall 43 contacts the bottom wall 101 of the cover, and the container flange 45 contacts the top of the cover 31. The top of the cover is interposed between the flange 45 and the tube 29.

The tube cover 31 has eyelets 33 (such as D-rings) coupled to its outside diameter. The eyelets are coupled to the tube cover by way of webbing 34.

Figure 2:
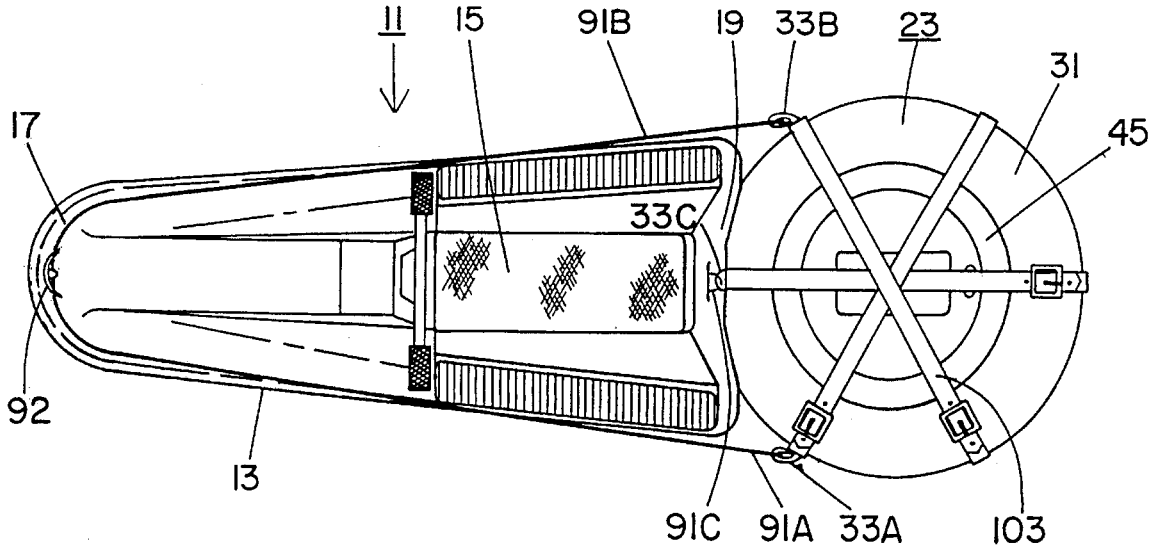
FIG. 2 is a top plan view of the personal watercraft shown with the accessory of the present invention, in accordance with a preferred embodiment, coupled thereto.

The use of the storage accessory 23 will now be described. The storage accessory 21 is coupled to the stern 19 of the personal watercraft 11. Referring to FIG. 2, the tube cover 31 contacts the stern. At least two eyelets 33 are used in coupling the storage accessory 23 to the watercraft. In the preferred embodiment, three eyelets 33 are used. A line 91A extends from a port eyelet 33A along the port side of the personal watercraft to a bow eyelet 92 (that is coupled to the bow of the watercraft), where the line is secured. Another line 91B extends from a starboard eyelet 33B along the starboard side of the personal watercraft to the bow eyelet 92. A center eyelet 33C is directly coupled to a stern clasp 93. The storage accessory is pulled against the stern 19 by the lines 91A, 91B such that the tube 29 is flattened, or deformed, somewhat against the stern 19. If the watercraft does not have a stern eyelet, then the storage accessory 21 can be coupled to the watercraft with two eyelets, with one eyelet on the port side of the watercrafts centerline and the other eyelet on the starboard side.

Because the storage accessory 21 is coupled to the personal watercraft 11, the storage accessory and the personal watercraft move in unison as the personal watercraft moves across the water 107 (FIG. 1). This of course is true for forward motion and stopping. But it is also true for pitches, rolls, and yaws. For example, as the personal watercraft banks into a turn, the storage accessory banks in a similar manner. Thus, the storage accessory acts like an extension of the personal watercraft hull. By having the storage accessory and the personal watercraft move in unison, the storage accessory tows effortlessly behind the personal watercraft. In fact, I have tested the storage accessory on the water. The towing watercraft was traveling at 30 mph and executed a 180 degree turn. The storage accessory followed the hull and amazingly remained coupled to the hull.

In addition, the leading edge of the tube is located on top of the transom of the personal watercraft (as can be seen in FIG. 2, where the tube overlaps the stern edge of the watercraft). Most personal watercraft are propelled forward by a jet of water that exits from underneath the stern of the personal watercraft. Locating the leading edge of the tube on the transom causes the thrust to the water jet to be located below the storage accessory 23. The water jet pushes the storage accessory up, thereby allowing the storage accessory to plane over the water. Planing over the water reduces drag and increases the fuel efficiency and speed of the personal watercraft. It is my experience that the storage accessory will begin to plane when the personal watercraft is only traveling at about three miles per hour. This is a slow speed that is commonly used in both harbors. Thus, even at slow harbor speeds, the storage accessory presents minimal drag. As a result, maneuverability of the personal watercraft is largely unaffected.

Furthermore, the flange 45 on the container 27 bears on the top of the tube 29 and thereby supports the weight of the container and its contents. This support prevents the bottom wall 43 of the container from extending below the bottom of the tube 29. The bottom wall thus stays flush with the tube thereby minimizing drag to the water. In fact, the rigid bottom wall 43 causes the bottom wall 101 of the tube cover (which is flexible) to remain flat, thereby reducing drag. (In the absence of the container, just pulling the tube and its cover across the water causes the bottom wall 101 of the cover to deform. The deformation causes drag.)

Furtherstill, the container 27, with its bottom wall, lowers the center of gravity of the tube, making the whole container-tube arrangement more stable on the water.

To load the main storage compartment 37, the lid 49 is removed, as is the net 81. Objects are then placed into the storage compartment on top of the foam cushion 89. The net 81 is placed on top of the objects and secured with the clasps 85. The lid 49 is then replaced. The objects will exhibit little or no shifting during movement because they are firmly held between the foam cushion 89 and the net 81.

The small storage compartment 63 can be used as an ice chest. Alternatively, a can of gasoline can be located therein. The small lid 73 is not used when a gas can is stored in the small storage compartment because the can typically protudes up out of the compartment. The gas can is tied in a manner to be described below. Alternatively, the can is pressed down into the compartment 63 by larger objects 25. The small storage compartment 63, by virtue of its side wall 65 and bottom wall 69, separates its contents from the contents of the larger storage compartment 37. Water from melted ice or fumes from a gas can will not penetrate into the larger storage compartment 37.

Objects 25 that are too big to fit inside one of the storage compartments 37, 63 can be placed on top of the storage accessory 27 (see FIG. 1). The objects bear on the lids 49, 73 and the flange 45. Lines 103 traverse from one eyelet 33 over the objects and down to the opposite eyelet. Several lines 103, tightly drawn, are used to secure the objects to the top.

When the personal watercraft 11 reaches its destination, the tube 29 and its cover 31 can remain coupled to the stern 19. The container 27 can be lifted from the tube 29 and carried to the beach, car, etc. The container is easily lifted by its flange 45. Two people can pick up the container and carry it.

The container 27 can serve as a table, as shown in FIG. 4. For example, when the personal watercraft arrives at a beach, the container can be placed on the beach 111, with bottom wall 43 contacting the ground. The flange 45 and lids 49, 73 serve as a table top, supporting cans 78 and other objects.

When the container 27 is removed from the tube 29, the tube 29 and its cover 31 can be towed behind the personal watercraft for entertainment. Instead of the towing the tube immediately behind the personal watercraft, the tube is towed at some distance. To accomplish this, the tube cover is detached from the stern. A single line can be tied between the stern eyelet 93 and the tube cover. The tube can thus be towed around the water in a conventional manner, as described in my U.S. Pat, No. 5,279,510. A person sits inside of the tube on top of the cover bottom wall 101.

Back at the boat dock, the storage accessory is easily transported over land. To ready the storage accessory for trailering or transport. The container is removed from the tube. The tube is deflated, folded and stored either in the container or in the towing vehicle (car or truck). The personal watercraft is typically placed upon a wheeled trailer that is towed by the towing vehicle. The container is turned upside down and located on the seat of the personal watercraft. The container is then tied down. Thus, the storage accessory requires no additional trailer space.

The container 27 can be used in a variety of tubes and covers. For example, my U.S. Pat. No. 5,122,086 shows an apparatus that has three in-line tubes. Such an apparatus can carry three containers 27, one container in each tube. Such a storage system can be used on extended trips.

The foregoing disclosure and the showings made in the drawings are merely illustrative of the principles of this invention and are not to be interpreted in a limiting sense.

I claim:

1. A storage accessory for use with a personal watercraft, comprising:

a) a floatable member that is toroidal in shape, the floatable member having a top, a bottom and a center cavity;

b) a container comprising a cylindrical wall, the cylindrical wall forming a storage compartment therein, the cylindrical wall having a top and a bottom, the cylindrical wall having a bottom wall and an opening in the top to allow access to the storage compartment;

c) the container comprising a rigid flange located at the top of the cylindrical wall and extending radially outward therefrom;

d) the cylindrical wall being located within the center cavity of the floatable member, and the flange being located on the top of the floatable member;

e) the container further comprising a lid for the opening, the lid being coplanar with the flange.

2. The storage accessory of claim 1 wherein the lid further comprises a second wall that depends from the lid, the second wall forming a second storage compartment therein.

3. The storage accessory of claim 2 further comprising:

a) the cylindrical wall of the container is rigid;

b) the floatable member is a tube;

c) a cover for the floatable member, the cover extending along the top of the floatable member, around an outer side of the floatable member, and along the bottom of the floatable member and the bottom wall of the cylindrical wall;

d) tie downs coupled to the cover.

4. A storage accessory for use with a personal watercraft, comprising:

a) a floatable member that is toroidal in shape, the floatable member having a top, a bottom and a center cavity;

b) a container comprising a cylindrical wall, the cylindrical wall forming a storage compartment therein, the cylindrical wall having a top and a bottom, the cylindrical wall having a bottom wall and an opening in the top to allow access to the storage compartment;

c) the container comprising a rind flange located at the top of the cylindrical wall and extending radially outward therefrom;

d) the cylindrical wall being located within the center cavity of the floatable member, and the flange being located on the top of the floatable member;

e) a cover for the floatable member, the cover extending along top of the floatable member, around an outer side of the floatable member, and along the bottom of the floatable member and the bottom wall of the cylindrical wall.

5. A watercraft, comprising:

a) a motorized personal watercraft having a stern and a seat located above a waterline of the personal watercraft;

b) a towable storage accessory comprising a container and a floatable member;

c) the container comprises a side wall forming a storage compartment therein, the side wall having a top and a bottom, a bottom wall being coupled to the bottom of the side wall so as to close a bottom of the storage compartment, the container also comprising a rigid flange that extends out from the top of the side wall;

d) the floatable member encircles the side wall of the container, with the flange beating on a top surface of the floatable member, the floatable member being flexible;

e) the floatable member being coupled to the stern of the personal watercraft.

6. The watercraft of claim 5 wherein the floatable member comprises a toroidally shaped tube and a cover that extends around a top of the tube, an outside of the tube, and the bottom wall of the container.

7. The watercraft of claim 6 wherein the side wall and the bottom wall of the container are rigid, and the bottom wall is flush with a bottom of the tube.

8. The watercraft of claim 7 wherein the container is removable from the floatable member.

9. The watercraft of claim 5 wherein the floatable member is pressed against the stern of the personal watercraft so as to cause deformation of the floatable member.

10. The watercraft of claim 9 wherein the floatable member is coupled to the personal watercraft with a multi point coupling.

11. The watercraft of claim 5 wherein the floatable member overlaps a transom of the personal watercraft so that a water propulsion jet produced by the personal watercraft is located beneath the storage accessory.

12. The watercraft of claim 5 further comprising a cushion located inside of the storage compartment and on the bottom wall.

13. The watercraft of claim 5 further comprising means for securing objects located inside of the storage container to the bottom wall.

14. The watercraft of claim 5 wherein the container further comprises a lid for covering the storage compartment, the lid being coplanar with the flange.

15. The watercraft of claim 14 wherein the lid further comprises a second wall that depends from the lid, the second wall forming a second storage compartment therein.

16. The watercraft of claim 5 further comprising:

a) the floatable member comprises a toroidally shaped tube and a cover that extends around the top of the tube, an outside of the tube, and the bottom wall of the container;

b) the side wall and the bottom wall of the container are rigid, and the bottom wall is flush with the bottom of the tube;

c) the container is removable from the floatable member;

d) the floatable member is pressed against the stern of the personal watercraft so as to cause deformation of the floatable member;

e) the floatable member is coupled to the personal watercraft with a multi point coupling;

f) the floatable member overlaps a transom of the personal watercraft so that a water propulsion jet produced by the personal watercraft is located beneath the storage accessory;

g) the container further comprises a lid for covering the storage compartment, the lid being coplanar with the flange;

h) the lid further comprises a second wall that depends from the lid, the second wall forming a second storage compartment therein.

* * * * *